United States Patent [19]

Ju

[11] Patent Number: 4,748,753

[45] Date of Patent: Jun. 7, 1988

[54] GOLF SHOES

[76] Inventor: Chang N. Ju, 411-1/2 Main, Eau Claire, Wis. 54701

[21] Appl. No.: 22,668

[22] Filed: Mar. 6, 1987

[51] Int. Cl.[4] ..... A43B 5/00; A43B 19/00; A43C 15/00

[52] U.S. Cl. ..... 36/127; 36/50; 36/71; 36/134

[58] Field of Search ..... 36/127, 134, 114, 58.5, 36/71, 50

[56] References Cited

U.S. PATENT DOCUMENTS

| | | | |
|---|---|---|---|
| 752,172 | 2/1904 | Manss | 36/50 |
| 2,078,626 | 4/1937 | Bauer | 36/127 X |
| 2,095,095 | 10/1937 | Howard | 36/134 X |
| 3,237,319 | 3/1966 | Hanson | 36/71 X |
| 3,555,706 | 1/1971 | Edmonds | 36/71 X |
| 4,135,317 | 1/1979 | Ikeda | 36/134 |
| 4,226,032 | 10/1980 | Herro | 36/127 |
| 4,367,600 | 1/1983 | Cross, III et al. | 36/127 |

FOREIGN PATENT DOCUMENTS

| | | | |
|---|---|---|---|
| 2037001 | 2/1972 | Fed. Rep. of Germany | 36/114 |

OTHER PUBLICATIONS

Competitive Edge Golf Catalog, Spring 1987; pp. 2 and 22.
Austad's 1987 Golfer's Spring Catalog; pp. 44–47.
Dexter 1986 Golf Catalog; pp. 4–15.
Dexter brochure on shoe making procedure.
Etonic 1986 Golf Shoe Catalog; pp. 2–22.
Bostonian 1986 Golf & Dress Shoes Catalog; pp. 2–18.
Foot-Joy advertistment from Golf Digest Feb. 1984.
Foot-Joy 1983 Catalog; pp. 3–18.

*Primary Examiner*—James Kee Chi
*Attorney, Agent, or Firm*—Merchant, Gould, Smith, Edell, Welter & Schmidt

[57] ABSTRACT

Golf shoes which provide for maximum traction and foot support during the rolling of the feet at the extremes of the golf swing. The golf shoes include a side heel with a second bottom which is inclined with respect to the first bottom. The second bottom in combination with pads on opposite sides of and slightly beneath and behind the ankle provide ankle support. The soles of the shoes are curved. The soles are thin and flat. Cleats are provided on the toes. The shoes conform closely with the foot, provide support when needed, especially during follow-through, and provide an added amount of traction.

10 Claims, 2 Drawing Sheets

GOLF SHOES

FIELD OF THE INVENTION

The present invention is directed to the general field of shoes and, more particularly, to shoes useful in the sport of golf.

BACKGROUND OF THE INVENTION

Although numerous factors enter into playing a good game of golf, a consistent golf swing is certainly extremely important. A consistent golf swing maximized the control which the golfer has over where the ball will go. Proper body movement, balance, and foot traction are essential to a consistent golf swing. Golf shoes are an aid in this regard.

Known golf shoes have a sole with a heel attached thereto. A plurality of cleats are attached to the toe portion of the sole and to the heel. The shoe upper is formed like any conventional pair of oxford shoes.

The problem with known golf shoes is that the heel elevates the golfer with respect to his toe so that the distance between the golfer's body and the ball varies during various parts of the swing of the club. In addition, known golf shoes have extended soles with sharp corners at the edges. As a golfer tries to rotate about these sharp corners during his backswing or follow-through, consistent body movement and balance are affected. Also, as the golfer attempts to follow-through, it is not possible for him to rotate his foot from the bottom toward the side, since the sharp corners on the heel and outer sole resist rotation initially and then provide no support once rotation about the sharp corner begins. The result is that any golfer without strong ankles either experiences pain or possible ankle injury or the golfer holds back on a natural follow-through. A consistent swing of the club is thus difficult as is well known to those golfers who play infrequently. Furthermore, even if a consistent golf swing is attained, it usually has less effectiveness than is possible.

SUMMARY OF THE INVENTION

The present invention is directed to golf shoes which each include a shoe upper and a sole mechanism attached to the shoe upper for rigidifying the shoe upper with respect to the ground. The sole mechanism has a first bottom and an inclined side heel along the outer side of each of the shoes. The side heel has a second bottom. The first and second bottoms directly beneath the wearer's ankle have first and second widths, respectively, such that the second width of the second bottom is at least one third as long as the first width of the first bottom. The inclined second bottom thus provides ankle support for the wearer during the critical follow-through portion of the golf swing.

Preferably, the golf shoes include additional features which increase the likelihood of proper body movement, balance and foot traction. In particular, the sole is formed to have a generally constant thickness at all locations along the first bottom. As a result, the golfer's body remains at a consistent distance with respect to the ball at all portions of the golf swing. In addition, the sole is formed to have an arcuate outer edge to generally conform to the upward curvature of the wearer's foot. In this way, the golfer's foot may rotate on the edge of the sole without resistance from an extended squared-off sole like with known golf shoes.

The features of an inclined second bottom provides best support when it is inclined with respect to the first bottom at an angle no less than 115 degrees and no greater than 150 degrees. During the follow-through of a golf swing, the second heel thus allows the golfer to complete a natural follow-trhough and incline the heel of his foot with respect to the ground with confidence knowing that the second bottom of the side heel will provide support at the appropriate time.

Additionally, it is advantageous to shape the shoe upper so that it has an upper edge which is closer to the wearer's ankle on the outer side of the shoe than on the inner side of the shoe. A first pad is attached to the shoe upper for fitting into a cavity formed in the wearer's foot beneath and slightly behind the wearer's ankle. A second pad is attached on the inner side of the shoe upper in the same region. The first and second pads provide additional rigidity and support for the ankle as the golfer rotates from the first bottom to the second bottom during the golf swing. A cord extends around the shoe upper near the upper edge and is tied near the front of the wearer's foot. The cord snugs the upper portion of the shoe upper to the wearer's foot to insure that the pads provide the support intended.

The cleats of the golf shoes of the present invention provide further advantage relative to known golf shoes. The sole of each shoe is formed to arcuately wrap upwardly to the toe of the sole. A plurality of cleats are attached to the toe of the sole to provide stability and traction for the trailing foot during the follow-through portion of the golf swing when the golfer pivots his trailing foot about his toes. In addition, since the sole of the shoe is of generally constant thickness, it is possible to attach one or more cleats under the arch of the wearer's foot. Such cleats provide traction during both the backswing and the follow-through. Known golf shoes have a hollow region beneath the arch of a wearer's foot so that a cleat could not be located there. Additionally, golf shoes in accordance with the present invention preferably locate the cleats which are attached to the bottom of the sole in a region comprising the outer three-fourths inch of the sole. It is this outer edge portion which is critical to maintaining traction during the extremes of a swing.

These various features and advantages of the present invention distinguish it from known golf shoes. These advantages and features are further explained and, consequently, may be better understood by reference to the drawings, a brief description of which follows, and the detailed description of the preferred embodiment which follows the drawings:

DETAILED DESCRIPTION OF THE PREFERRED EMBODIMENT

Figure 1:
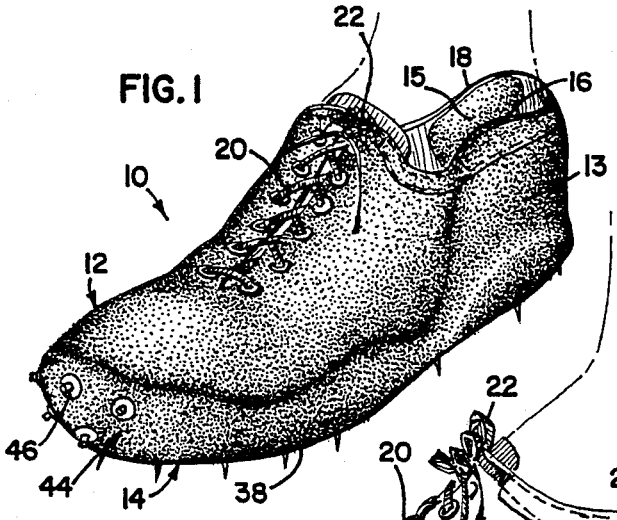
FIG. 1 is a perspective view of a golf shoe in accordance with the present invention.
Figure 2:
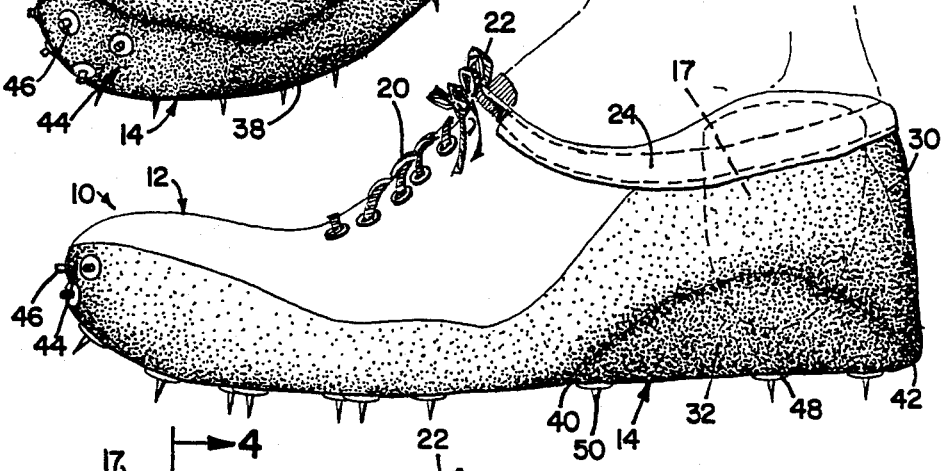
FIG. 2 is an elevational view of the outer side of the shoe of FIG. 1.
Figure 3:
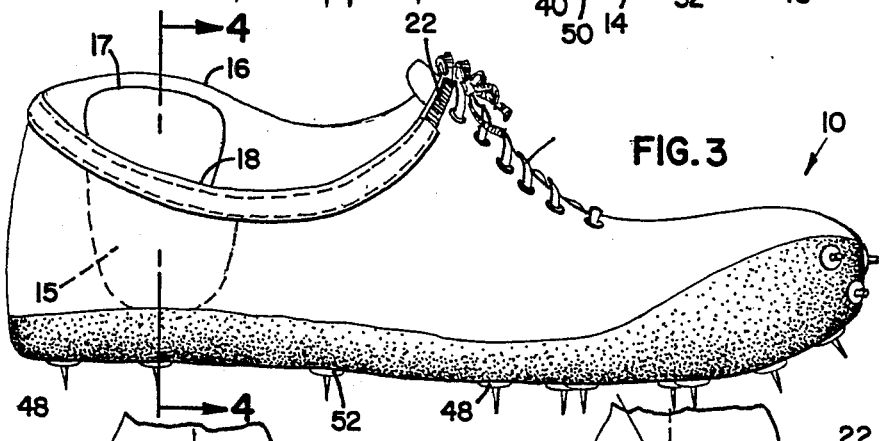
FIG. 3 is an elevational view of the inner side of the shoe of FIG. 1.

Referring now to the drawings wherein like reference numerals designate identical or corresponding parts throughout the several views, and more particularly to FIG. 1, a golf shoe in accordance with the present invention is designated generally by the numeral 10. Shoe 10 is shown for the left foot of a person. It is understood that a shoe for the right foot is the same as the left foot shoe except it is a mirror image of the left foot shoe. Considering a pair of shoes in accordance with the present invention, the pair has inner sides 11 which face one another and outer sides 13 which are on sides opposite from the inner sides.

Considering one shoe of the pair as shown in the drawings, shoe 10 includes a shoe upper 12 and an outer sole 14. The outer sole 14 is shaped uniquely as described hereinafter. Shoe upper 12 is formed in an oxford shape, except the outer side upper edge 16 is nearer the wearer's ankle than the inner side upper edge 18. Inner side upper edge 18 is cut lower than outer side upper edge 16 so that when the when the wearer's foot rolls on its side during the follow-through portion of a golf swing, the top of the inner side of the shoe upper 12 will not exert excessive pressure on the ankle.

A relatively firm first pad 15, preferably made of a foam rubber, is attached to the inside of shoe upper 12 on the inner side 11 of shoe upper 12 at a location beneath and slightly behind the wearer's ankle. Similarly, a second pad 17 made from a similar material is attached to the inside of shoe upper 12 on outer side 13 of shoe upper 12 at a location beneath and slightly behind the other side of the wearer's ankle. The pads 15 and 17 provide support and rigidity to an otherwise relatively weak region of the ankle and in combination with side heel 30, provide support for the golfer's ankle during a golf swing, especially during follow-through.

A first cord 20 is laced in the usual way and tied to hold opposite sides of shoe upper 12 together. A second cord 22 passes through a passageway 24 formed along the upper edge of shoe upper 12. Cord 22 thus extends in passageway 24 in shoe upper 12 around shoe upper 12 near its upper edge and has ends which are tied in the front of the wearer's foot. Second cord 22 insures that first and second pads 15 and 17 are held tightly in the cavities beneath and slightly behind the wearer's ankle to provide the intended support.

Figure 4:
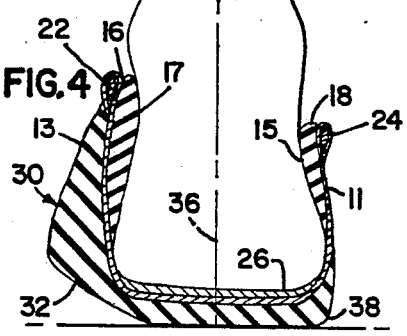
FIG. 4 is a cross-sectional view taken along line 4—4 of FIG. 3.
Figure 5:
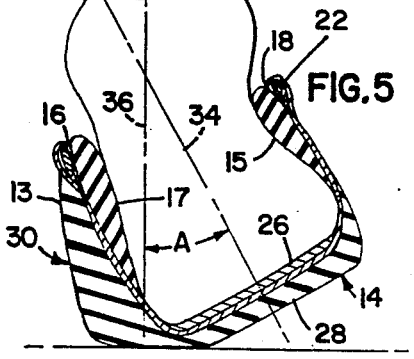
FIG. 5 is a view similar to FIG. 4, except the shoe has been rotated from the first bottom to the second bottom.

As shown in FIGS. 4 and 5, golf shoe 10 preferably includes an inner sole 26, as well as an outer sole 14. The shoe upper 12 is shown to be a continuous piece of material extending from one side of the shoe to the other. In this regard, it is understood that shoe upper 12 may be more than one layer of material. It is further understood that shoe upper 12 need not be continuous and may be stitched near mating edges to outer sole 14. Even if shoe upper 12 is continuous, it is preferably stitched, although not shown in the drawings, to outer sole 14. Although not necessary, in either case, it is preferable to have an inner sole 26 covering any stitching to provide a smooth flat surface for the foot. In any case, such internal construction of the shoe is not a part of the invention and any construction which is capable of attaching the shoe upper 12 to the outer sole 14 is acceptable.

As with any hard sole shoe, outer sole 14 rigidifies shoe upper 12 with respect to the ground. Sole 14 includes a first bottom 28. In a region generally under the ankle along the outer side 13, sole 14 has a side heel 30. Side heel 30 extends preferably to passageway 24 near upper edge 16 of shoe upper 12. The lower portion of side heel 30 is flattened to form a second bottom 32. First bottom 28 arcuately mates with second bottom 32. Second bottom 32 is inclined with respect to first bottom 28 and angled no less than 115 degrees and no greater than 150 degrees. In other words, angle A (see FIG. 5) between the perpendiculars 34 and 36 of first and second bottoms 28 and 32, respectively, is preferably between 25 degrees and 60 degrees.

First and second bottoms 28 and 32 in a region directly beneath the wearer's ankle have first and second widths, respectively, such that the second width of second bottom 32 is at least one third as long as the first width of first bottom 28. Formed in this way, the width relationship and the angular relationship between the first and second bottoms provide ankle support for the wearer during the crucial follow-through portion of a golf swing. FIG. 4 shows the orientation of a shoe 10 when a golfer addresses his ball. FIG. 5 shows the orientation of a shoe 10 for the leading foot of the golfer during the follow-through portion of a swing.

Outer sole 14 has a generally constant thickness at all locations along the first bottom 28. Also, outer sole 14 has an arcuately formed outer edge 38 so that sole 14 generally conforms to the upward curvature of the wearer's foot. Edge 38 is, therefore, approximately equidistant from the wearer's foot all around the sole. That is, the arcuate edge 38 extends around shoe 10 from one end 40 of side heel 32 to the other end 42.

Thus, compared to known golf shoes, outer edge 38 of sole 14 has been cut directly under the edge of the wearer's foot and curved to follow a contour similar to the natural shape of the foot. Furthermore, sole 14 is as thin and flat as possible to reduce torque on the ankle and to reduce foot slipage as the foot rolls during the follow-through portion of the golf swing. As compared with known golf shoes, the effect on the golfer is that the distance from the ball at all points of the swing, and especially at the low point of the swing, is more consistent and, consequently, produces more accurate contact with the ball. This contrasts with known golf shoes having extended soles and sharp corners which allow the distance between the golfer and the ball to vary considerably with each swing as the golfer struggles against the resistance to put rotation because of the extended soles.

The toe portion of outer sole 14 curves arcuately upwardly from first bottom 28 to almost the top of the toe. Toe portion 44 may be flattened toward the front to provide for greater gripping and traction by the cleats attached to toe portion 44. It is understood, however, that toe portion 44 need not necessarily be flattened.

A plurality of cleats 46 are attached to toe portion 44. Preferably, three cleats are attached in a row at a higher elevation than two cleats which are attached in a lower second row. The cleats 46 in the second row are preferably spaced halfway between the cleats 46 of the first row so that cleats 46 present a "W" formation. For safety, cleats 46 are blunt ended cylinders which protrude approximately three millimeters and are approximately three millimeters in diameter.

Figure 6:
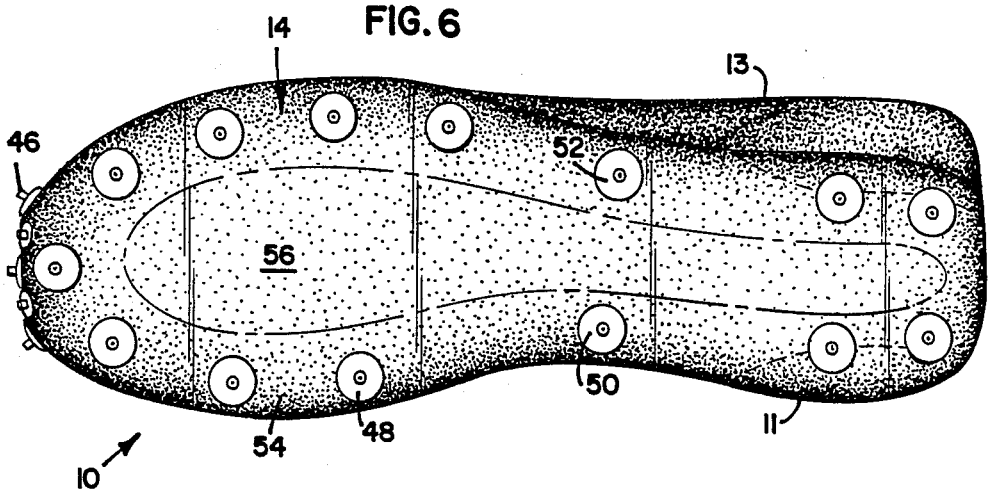
FIG. 6 is a bottom view of the shoe of FIG. 1.

As shown in FIG. 6, cleats 48 are attached to first bottom 28. Since first bottom 28 is flat and does not include an elevated heel, it is possible and preferable to include a cleat 50 at a location under the arch of the wearer's foot, and a cleat 52 at a location directly opposite the arch of the wearer's foot. Cleats 50 and 52 provide an extra, but crucial, traction during the extremes of the golf swing, i.e., the backswing and the follow-through. The rest of cleats 48 are preferably located around the edge portion of first bottom 28. In this regard, edge portion 54 is no more than three-fourths inch from outer edge 38. Edge portion 54 is shown in FIG. 6 relative to central portion 56 as separated by a broken line. A plurality of cleats 48 are regularly spaced along edge portion 54 on both sides of the forward end of the shoe and on both sides of the heel portion of the shoe.

To use, the feet of the golfer are inserted in shoes 10 in normal fashion. First cord 20 is laced and tied to hold opposite sides of shoe upper 12 together. Second cord 22 is snugged and tied to hold first and second pads 15 and 17 in the cavities formed beneath and slightly behind the wearer's ankle. The wearer is then ready to play golf. In this regard, it is noted that it does not matter whether the golfer is right handed or left handed since a side heel 30 is fastened to the outer side 13 of both shoes and since the shoes are otherwise generally a mirror image of one another.

During a golf swing, the plurality of cleats 48 provide traction during the backswing. At the extreme of the backswing, cleat 50 provides added traction for the leading foot, while cleat 52 provides added traction for the trailing foot. During the main part of the swing, all of cleats 48 are of varying importance to foot traction. As the golfer goes into the follow-through portion of the swing, the leading foot rolls outwardly around edge 38, and it is at this time that second bottom 32 of side heel 30 provides the critical ankle support. First and second pads 15 and 17 provide additional support. Because of the general conformance of outer sole 14 to the wearer's foot, and particularly the arcuate shape at the edges, the golfer may naturally roll the leading foot from the bottom of his foot to the side thereby obtaining the fullest extension of the body that is possible during the backswing and thereby the fullest amount of power possible. While this is occurring at the leading foot, the trailing foot is pivoting from the first bottom to toe portion 44. It is thus during the follow-through portion of the swing that cleats 46 provide traction as the trailing foot pivots and rotates onto toe portion 44.

A pair of shoes 10 allows a golfer to take a more natural swing, although somewhat different then with known shoes due to the constraints of known shoes.

These advantages and details of structure and function, although set forth in length, are nevertheless exemplary and it is understood that equivalents are possible. Therefore, it is understood that changes made, especially in matters of shape, size and arrangement to the full extent extended by the general meaning of the terms in which the appended claims are expressed, are within the principle of the present invention.

What is claimed is:

1. A pair of golf shoes having inner and outer sides, said inner sides of said pair facing one another, said outer sides being on sides of said shoes opposite from said inner sides, each of said shoes comprising:

a shoe upper; and sole means, attached to said shoe upper, for rigidifying said shoe upper with respect to the ground, said sole means having a first bottom and an inclined side heel along said outer side, said side heel having a second bottom, said first and second bottoms directly beneath the wearer's ankle having first and second widths, respectively, said second width being at least one third as long as said first width, whereby said second bottom provides ankle support for said wearer during follow through while swinging a golf club.

2. Golf shoes in accordance with claim 1 wherein the second bottom of said side heel is inclined with respect to the first bottom at an angle no less than 115 degrees and no greater than 150 degrees.

3. Golf shoes in accordance with claim 1 wherein said sole means includes an outer sole having an arcuately formed outer edge so that said sole generally conforms to the upward curvature of the wearer's foot, said arcuately formed edge being approximately equidistant from said wearer's foot and extending around said shoe from one end of said side heel to the other.

4. Golf shoes in accordance with claim 1 wherein said sole means includes a sole having a generally constant thickness at all locations of said first bottom.

5. Golf shoes in accordance with claim 1 wherein said shoe upper has an upper edge which is closer to the wearer's ankle on the outer side of the shoe than on the inner side of the shoe.

6. Golf shoes in accordance with claim 5 including a pad attached to said shoe upper for fitting into a cavity formed in said wearer's foot beneath and slightly behind the wearer's ankle, said pad being on one of said inner and outer sides.

7. Golf shoes in accordance with claim 6 including a cord extending around said shoe upper near said upper edge, said cord having ends which are tied near the front of said wearer's foot.

8. Golf shoes in accordance with claim 1 wherein said sole means includes a sole which is arcuately formed to wrap upwardly at the toe of said shoe, said shoe including a plurality of cleats attached to said first bottom and a plurality of cleats attached to said upwardly formed portion of said sole at the toe of said shoe.

9. Golf shoes in accordance with claim 1 wherein said sole means includes a sole including said first bottom surrounded by an outer edge which is rounded upwardly, said first bottom having a central portion surrounded by an edge portion, said edge portion being no more than three-fourths inch from said rounded outer edge, said shoe including a plurality of cleats attached to said first bottom, all of said cleats attached to said first bottom being attached to the edge portion.

10. A pair of golf shoes having inner and outer sides, said inner sides of said pair facing one another, said outer sides being on sides of said shoes opposite from said inner sides, each of said shoes comprising:

a shoe upper having an upper edge which is nearer the wearer's ankle on the outer side of the shoe than on the inner side of the shoe;

first and second pads attached to said shoe upper for fitting into cavities formed in said wearer's foot beneath and slightly behind the wearer's ankle, said first pad being attached to the inner side of said shoe upper, said second pad being attached to the outer side of said shoe upper;

a cord extending around said shoe upper near said upper edge, said cord having ends which are tied near the front of said wearer's foot;

sole means, attached to said shoe upper, for rigidifying said shoe upper with respect to the ground, said sole means having a first bottom and an inclined side heel along said outer side, said side heel having a second bottom, said second bottom being inclined with respect to said first bottom at an angle no less than 115 degrees and no greater than 150 degrees, said sole means including an outer sole having an arcuately formed outer edge so that said outer sole generally conforms to the upper curvature of the wearer's foot, said arcuately formed outer edge being approximately equidistant from said wearer's foot and extending around said shoe from one of said side heel to the other, said outer sole being arcuately formed to wrap upwardly at the toe of said shoe to form a toe portion of said outer sole; and a plurality of cleats attached to said outer sole, several of said plurality being attached to said toe portion.

* * * * *